US006202246B1

(12) United States Patent
Boucher

(10) Patent No.: US 6,202,246 B1
(45) Date of Patent: Mar. 20, 2001

(54) MULTI-PURPOSE SCRUB MOP

(76) Inventor: Laura Boucher, 4 Hunter Dr., Epping, NH (US) 03042

( * ) Notice: Subject to any disclaimer, the term of this patent is extended or adjusted under 35 U.S.C. 154(b) by 0 days.

(21) Appl. No.: 09/361,047

(22) Filed: Jul. 26, 1999

(51) Int. Cl.[7] ..... A47L 13/12

(52) U.S. Cl. ..... 15/115; 15/114; 15/144.1; 15/144.2; 15/144.4; 15/247; 15/DIG. 5; 15/DIG. 6; 401/138

(58) Field of Search ..... 15/106, 114, 115, 15/144.1, 144.2, 144.4, 247, DIG. 5, DIG. 6; 401/138

(56) References Cited

U.S. PATENT DOCUMENTS

| | | | | |
|---|---|---|---|---|
| 1,563,829 | * | 12/1925 | Brown | 15/114 |
| 1,838,481 | * | 12/1931 | Gudka | 15/114 X |
| 1,989,921 | * | 2/1935 | Goddard | 15/114 X |
| 2,584,515 | * | 2/1952 | Udell | 15/114 X |
| 2,653,335 | * | 9/1953 | Johnson | 401/138 |
| 2,845,644 | * | 8/1958 | Wisner | 15/114 |
| 3,407,424 | * | 10/1968 | Lanzarone et al. | 15/144.4 X |
| 4,756,039 | * | 7/1988 | Pardo | 15/DIG. 5 X |

FOREIGN PATENT DOCUMENTS

| | | | | |
|---|---|---|---|---|
| 713488 | * | 11/1941 | (DE) | 15/114 |
| 880394 | * | 6/1953 | (DE) | 15/115 |

* cited by examiner

*Primary Examiner*—Mark Spisich
(74) *Attorney, Agent, or Firm*—Michael J. Persson; Lawson, Philpot & Persson, P.C.

(57) ABSTRACT

An all-purpose cleaning apparatus and kit. The cleaning apparatus includes a head having a substantially triangular shape. The head includes a front portion having an interior and an exterior, a plurality of substantially long hard bristles extending from the exterior of the front portion, and a plurality of substantially short soft bristles extending from the interior of the front portion. The head also includes a rear portion manufactured of a sponge material. In the preferred embodiment, the head of the cleaning apparatus includes a top surface and a bottom surface, disposed in substantially parallel relation to one another such that the head has a substantially low profile, and a rounded front portion. The preferred cleaning apparatus also includes a telescoping handle removably attached to the rear portion of the head via a pivot joint, and an accessory holder dimensioned to secure a bottle to the handle.

19 Claims, 4 Drawing Sheets

MULTI-PURPOSE SCRUB MOP

FIELD OF THE INVENTION

The present invention relates to the field of cleaning tools, in particular, a cleaning apparatus and kit for cleaning multiple types of floors, tiles and grouts, ceilings, showers, and areas under cabinets and appliances, which traditional mops are unable to reach.

BACKGROUND OF THE INVENTION

A typical living or working space requires regular cleaning, which typically consists of washing and dusting floors, showers, dusting and washing ceilings, and dusting and cleaning furniture. However, often it is difficult to reach cathedral ceilings, apply dry carpet cleaners to delicate carpets, tile grout, and areas under low furniture, such as cabinets and appliances, using the same cleaning tool as used while washing showers and floors. Thus, when cleaning a living or working space, it is often necessary to use many different cleaning devices in order to properly clean all areas. This can be both time consuming and also provide physical discomfort, as many cleaning tools require one to climb and stand on ladders, kneel on the floor, or bend over.

In addition to the ergonomic considerations discussed above, multiple cleaning implements are also necessary due to the cleaning requirements of varied surfaces and types of dirt to be cleaned. For example, when cleaning a tile floor, it is often necessary to utilize a scrub brush in order to clean the grout between tiles, indents in tiles and linoleum which hold dirt, and a wet mop to clean tile surfaces. Between cleanings, the tiles and grout may be cleaned of surface dust utilizing a dry mop or broom.

Finally, there is no current cleaning apparatus that may be used on these varied surfaces without damaging delicate surfaces. For example, tile and other floors may be cleaned using multiple brushes, having hard and soft bristles respectively. However, these brushes are not adapted for cleaning furniture, and/or painted surfaces due to the risk of damage to those surfaces. Conversely, the soft cloths or dry mops typically utilized to clean these delicate surfaces are ineffective at cleaning floors.

Mops, both wet and dry, have been utilized for many years. In this time, many improvements have been made to the mop, and many of these improvements have been patented. For example, U.S. Pat. No. 1,832,541 (the '541 patent) discloses a rectangular mop from which a brush attachment extends. However, this invention fails as an all-purpose cleaning apparatus, as the rectangular shape makes it impossible to fit into the grout of tile, and other hard to reach places. In addition, the simple one brush attachment provides only one type of bristle, thereby leaving the typical person wanting another type of bristle and, thus, requiring another cleaning tool.

U.S. Pat. No. 2,472,781 discloses another rectangular mop having a sponge attachment that includes a plurality of bristles extending from its front surface. Like the mop of the '541 patent, this mop is able to scrub some tile. However, this mop is also lacking multiple bristle types and a mop head shape proper for reaching tile grout and other hard to reach places.

U.S. Pat. No. 2,518,765 discloses a mop having a pair of parallel and opposing sponges between which are disposed a plurality of bristles. This mop also lacks multiple bristle types and a mop head that is dimensioned to properly clean tile grout and other hard to reach places.

U.S. Pat. No. 2,701,888 discloses a rectangular sponge mop having a brush attachment that attaches to the top of the sponge and has a plurality of bristles disposed along its front face. Again, the rectangular shape is not proper for cleaning tile grout and other hard to reach places, and there is only one type of bristle.

U.S. Pat. No. 2,732,574 discloses a combined brush and mop having a dome shaped sponge portion and a plurality of bristle tufts extending radially from the flat dome top. Although this patent discloses a shaped sponge head with bristles, the shape is not proper for reaching tile grout and other hard to reach places, and there is only one type of bristle on the mop.

U.S. Pat. No. 2,895,152 discloses a rectangular sponge mop having a brush attachment fastened to it top surface. Again, the rectangular shape is not proper for reaching tile grout and other hard to reach places and there is only one type of brush attached to the mop, leaving the person cleaning wanting for other cleaning tools.

U.S. Pat. No. 3,115,656 discloses a rotatable head mop having a sponge on one surface, bristles on another surface and a squeegee on a third surface. Although the squeegee and rotatable head are improvements over the prior inventions, the shape of the sponge is still inconsistent with the proper shape for reaching tile grouts and other hard to reach places, and the lack of multiple bristle types makes it inappropriate for use as an all purpose cleaning apparatus.

U.S. Pat. No. 3,641,610 discloses a tufted sponge having a plurality of bristles extending through the body of the sponge. Again, the shape of the mop head is improper for cleaning tile grout and other hard to reach places, and there is only one type of bristle.

U.S. Pat. No. 3,656,202 discloses a combined sponge, scouring pile material, and squeegee implement, which utilizes a block of foamed resin material having a scrubbing face recessed within the resin. Although this is an improvement over prior inventions, this tool still lacks multiple bristle types and a head shaped for proper tile grout cleaning and other hard to reach places.

U.S. Pat. No. 5,097,561 discloses a wringer mop having an auxiliary brush attachment that replaces the sponge in some circumstances. This invention fails as an all-purpose cleaning tool for it does not have a proper mop head shape for cleaning tile grout and other hard to reach places and also does not have a mop head that includes both a sponge and bristles. Additionally, this mop does not have multiple bristle types, which is a requirement for an all-purpose cleaning tool.

U.S. Pat. No. 5,351,356 discloses a combination sponge and handle having a rectangular shaped portion and a flat brush attached at one side of the brush. The preferred embodiment includes a scraper blade for scraping snow and the like. However, this invention does not include a properly shaped head for cleaning tile grout and other hard to reach places, nor does it have multiple bristle types for use as an all-purpose cleaning tool.

U.S. Pat. No. 5,375,287 discloses a scrub brush for flat and cornered surfaces including a domed top for easy fit within a user's hand. The patent discloses the use of two different sets of bristles, each of the same material, but of differing length. Although this scrub brush can be used for more surfaces than prior inventions, there is no sponge disclosed. Further, the scrub brush is not adapted for use with a handle, and thus requires one to kneel down in order to clean floors, and is impossible to use for dusting furniture or ceilings.

U.S. Pat. No. 5,522,110 discloses a mop having an outer sponge section and an inner scrub brush section. However, all embodiments are rectangular which is a disadvantage for the tool can not be used to properly clean tile grout, nor reach under cabinets or appliances. Additionally, this tool does not disclose multiple sets of bristles having different lengths and hardness. Therefore, although this tool is useful for cleaning some areas, it may not be used as an all-purpose cleaning tool.

An all-purpose cleaning tool that can be used as a mop, a tile grout scrubber, a hard bristled brush, a soft bristled brush, a duster, a wood polisher, and a thin sponge for reaching under cabinets, appliances, and other hard to reach areas, is not known in the art.

SUMMARY OF THE INVENTION

The present invention is an all-purpose cleaning apparatus and kit, which is optimized for more efficient and comfortable cleaning of the living or working space. In its most basic form, the cleaning apparatus includes a head having a substantially triangular shape. The head includes a front portion having an interior and an exterior, a plurality of substantially long hard bristles extending from the exterior of the front portion, and a plurality of substantially short soft bristles extending from the interior of the front portion. The head also includes a rear portion manufactured of a sponge material. In the preferred embodiment, the head of the cleaning apparatus includes a top surface and a bottom surface, disposed in substantially parallel relation to one another such that the head has a substantially low profile, and a rounded front portion. The preferred cleaning apparatus also includes a telescoping handle removably attached to the rear portion of the head via a pivoting connection, an accessory holder including a plastic coated wire shelf and hook and loop straps attached to the handle and dimensioned to secure bottles and/or other cleaning accessories to the handle.

In its most basic form, the cleaning kit includes the head discussed above, and a handle dimensioned for attachment to the head. In the preferred embodiment, the head of includes a top surface and a bottom surface, disposed in substantially parallel relation to one another such that the head has a substantially low profile, and a rounded front portion. The preferred handle is a telescoping handle, which is adapted for removable attachment to the rear portion of the head via a pivoting connection. The preferred kit also includes an accessory holder including plastic coated wire shelf and hook and loop straps removably attached to the handle and dimensioned to secure bottles to the handle, and a dusting cover dimensioned for attachment to the head. The preferred dusting cover is manufactured of a thick flannel material to prevent the covered bristles from damaging wood floors, and includes an elastic portion for securing the dusting cover to the head.

Therefore, it is an aspect of the invention to provide a cleaning apparatus that serves as an all-purpose cleaning tool and cleaning kit for the office or home.

It is a further aspect of the invention to provide a cleaning apparatus and cleaning kit capable of serving as both a hand-held version, and long armed version, of an all-purpose cleaning tool.

It is a further aspect of the invention to provide a cleaning tool that can be used as a mop.

It is a further aspect of the invention to provide a cleaning tool which can be used as a tile grout scrubber.

It is a further aspect of the invention to provide a cleaning tool that can be used as a hard bristled brush.

It is a further aspect of the invention to provide a cleaning tool that can be used as a soft bristled brush.

It is a further aspect of the invention to provide a cleaning tool that can be used as a duster.

It is a further aspect of the invention to provide a cleaning tool that can be used as a wood polisher.

It is a still further aspect of the invention to provide a cleaning tool that can be used as a thin sponge for reaching under cabinets, appliances, and other hard to reach areas, such as corners.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
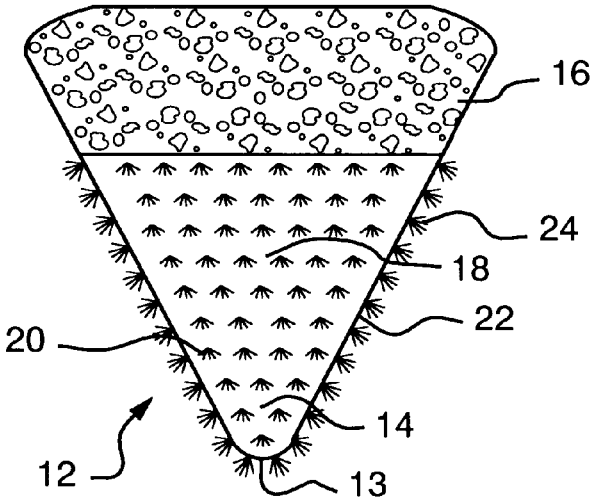
FIG. 1 is a top view of the head of the cleaning apparatus of the present invention.

Referring first to FIG. 1, the head 12 of the cleaning apparatus is shown. Head 12 preferably has a substantially triangular shape. Such a shape is preferred as it allows the head 12 to reach small, thin areas, such as grout between tiles, as well as areas having complex shapes.

The head 12 includes a front portion 14 having an interior 18, from which a plurality of substantially short soft interior bristles 20 extend, and an exterior 22, from which a plurality of substantially long hard exterior bristles 24 extend. The interior bristles 20 are preferably soft bristles for removing mildew and the like, from delicate surfaces that may be damaged by a harder bristle. The exterior bristles 24 are preferably hard bristles for removing stubborn stains, and stuck-on dirt and grime from resilient surfaces that are unlikely to be damaged by such a bristle. It is preferred that the interior and exterior bristles 20, 24 be arranged in rows of clusters, with such an arrangement being particularly effective at the edges and along the tip 13. The interior bristles 20 and exterior bristles 24 are manufactured of any material commonly utilized in similar cleaning apparatus and that have the requisite length and hardness properties. In the preferred embodiment, the interior and exterior bristles 20, 24 are each made of natural materials, such as boar bristles, of varying length and diameter. Other embodiments include the use of artificial material for the bristles. Similarly, artificial bristles of different materials, or a combination of artificial and natural bristles, may also be utilized to achieve the desired results.

The head 12 also includes a rear portion 16 manufactured of an absorbent material. An absorbent material is utilized in order to wipe up excess water and cleaning solutions after scrubbing with the front portion 14 of the head 12, and to allow the apparatus to be utilized as a conventional mop. As described more fully with reference to FIG. 2, the absorbent material is preferably a natural or artificial sponge material having a predetermined thickness. However, in some embodiments, the absorbent material is a fabric, such as cotton or absorbent artificial fabric, formed into a plurality of strands, such as those found in conventional wet mops.

Figure 2:
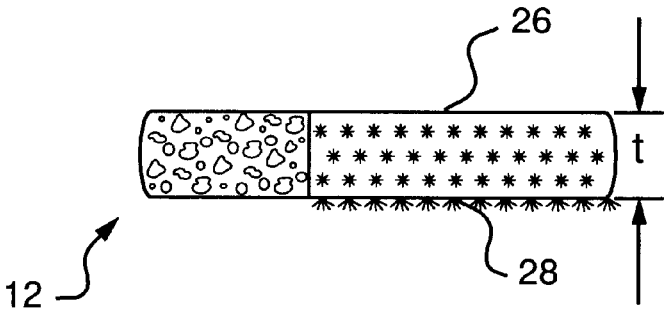
FIG. 2 is a side view of the head of FIG. 1.

As shown in FIG. 2, the preferred head 12 includes a top surface 26 and a bottom surface 28 disposed in substantially parallel relation to the top surface 26 such that the head 12 has a substantially low profile. This low profile is preferred in order to allow the head 12 to fit under cabinets, appliances, and the like. In the preferred embodiment, the head 12 has a thickness, t, of between 1.5 and 3 inches. Finally, although FIGS. 1 and 2 show head 12 as a stand alone cleaning apparatus, a handle or other gripping means may be added to the top surface 26 of the head 12 to adapt the head 12 for use as a scrub sponge or, as discussed further below, a long handle may be attached to the rear portion 16 of the head 12 in order to adapt the head 12 for use as a dry or wet mop.

Figure 3:
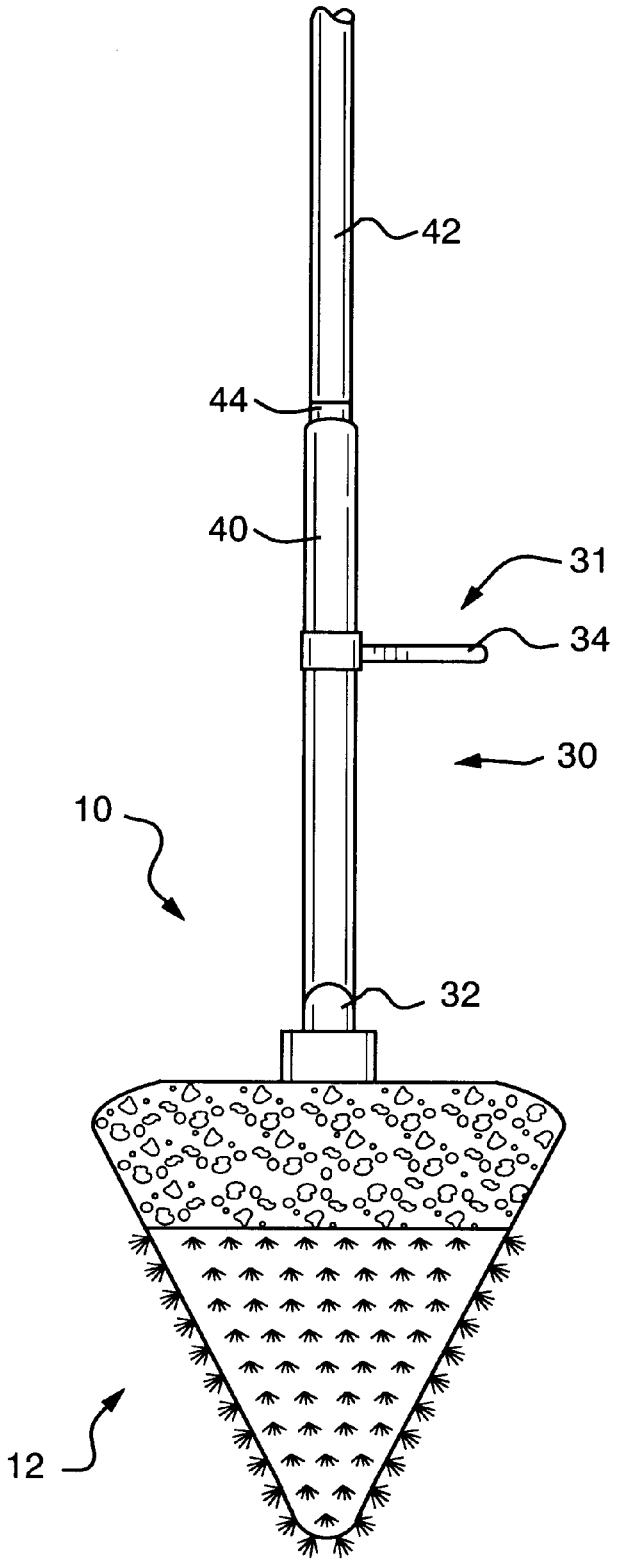
FIG. 3 is a top view of the preferred assembled cleaning apparatus of the present invention.

Referring now to FIG. 3, the preferred cleaning apparatus 10 is shown. The preferred cleaning apparatus 10 includes the head 12, described at length with respect to FIGS. 1 and 2, a handle 30 attached to the head 12 via a pivoting connection 32, and a clip 34 removably attached to the handle. In this arrangement, the cleaning apparatus 10 takes the form of a mop, but is adapted to clean more and varied surfaces than may be cleaned using conventional mops.

Figure 4:
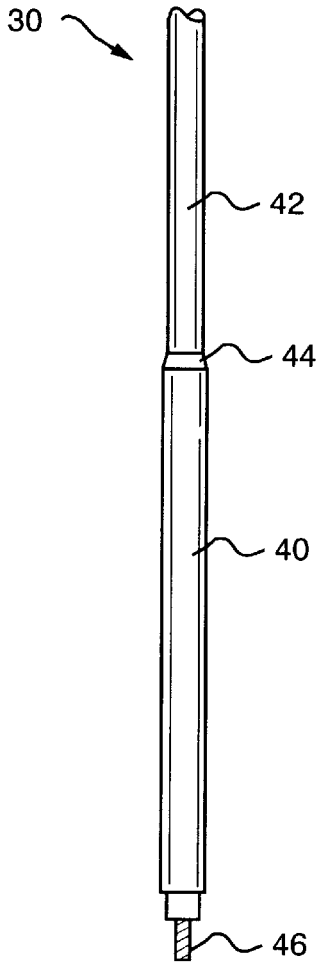
FIG. 4 is a side view of the telescoping handle of the cleaning apparatus of the present invention.

As shown in FIGS. 3 and 4, the preferred handle 30 is a telescoping handle that allows adjustment of the handle length dependent upon the surfaces to be cleaned. In such an embodiment, the bottom portion 40 is hollow and is adapted to receive the top portion 42. The top portion 42 may be solid or hollow and is held in place relative to the bottom portion 40 via a locking mechanism 44. The preferred locking mechanism 44 is a locking slip joint, such as those utilized on window washing tools manufactured by Sunshine Industries of Cleveland, Ohio under the trade name GERI RAFF™ extension handle. However, other art recognized locking mechanisms 44, such as locking screws, pins, clamps and the like, may be substituted to achieve similar results. The telescoping handle of the preferred cleaning apparatus extends to a length of 15 feet, and allows cathedral ceilings, areas under cabinets and appliances, and other hard to reach places, to be cleaned without the use of a ladder or other reaching device.

The handle 30 also includes attachment means 46, for attaching the handle to the head 12. As shown in FIG. 4, the preferred attachment means 46 is a threaded stud that is dimension for insertion within a threaded opening in the pivoting connection 32. In such an embodiment, the handle 30 is attached to the head 12 by aligning the stud with the opening and applying a torque to the handle 14 until the handle 14 is tightly connected to the pivoting connection 32. In other embodiments, however, a handle is fixedly attached to the head 12 in a similar manner. In still other embodiments, other attachment means 46, such as clips, glue, rivets, or the like, are utilized to fasten the handle 30 to the head 12.

Although a telescoping handle is preferred, in other embodiments the handle is a non-adjustable handle, such as those utilized in conventional mops and brooms. Such a handle may be either hollow or solid and is made of a material, such as plastic, metal or wood, commonly utilized in the art. Regardless of its adjustability and material of construction, however, the handle should have a diameter and cross section that provide sufficient strength when extended to a length that allows the apparatus to be utilized for cleaning ceilings, under cabinets, appliances and the like.

Figure 5:
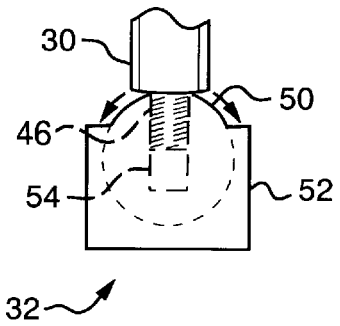
FIG. 5 is a cross-sectional view of the pivoting attachment, including phantom lines.

Referring now to FIGS. 3 and 5, the preferred cleaning apparatus 10 includes a pivoting connection 32 that allows the handle 30 to be pivoted relative to the head 12. As shown in FIG. 5, the preferred pivoting connection 32 is a ball 50 disposed within, and held captive by, a retainer 52. When utilized with a handle 30 having a threaded stud as an attachment means 46, the ball 50 includes a threaded opening 54 dimensioned to receive the threaded stud. In embodiments utilizing different attachment means 46, however, threaded opening 54 may be replaced by another mating connector that is suitable for attachment to the attachment means 46 of the handle 30. The pivoting connector 32 works by applying pressure on the handle 30 in the direction in which one wishes to place the cleaning tool, and is preferably capable of accomplishing a full range of 360° rotation.

Although a pivoting connector 32 is preferred, in other embodiments the handle 30 is movably attached to the head 12 via a rubberized flexor (not shown). As was the case with the pivoting connector, the rubberized flexor allows the head of the cleaning apparatus to move in angular relation to the handle, allowing a user to clean walls and floors without altering the cleaning apparatus, or choosing another apparatus. In still other embodiments, however, the pivoting connector 32 and rubberized flexor are eliminated, and the handle 30 is adapted for attachment directly to the head 12 of the cleaning apparatus 10.

Figure 6:
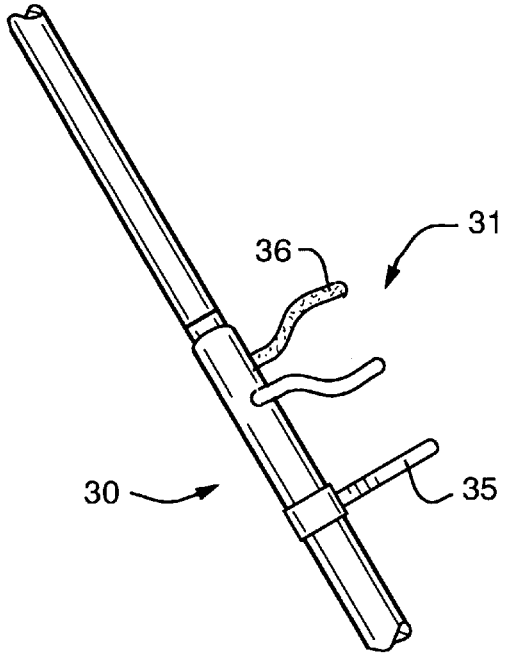
FIG. 6 is a side view of the accessory holder of the cleaning apparatus and kit of the present invention.
Figure 7:
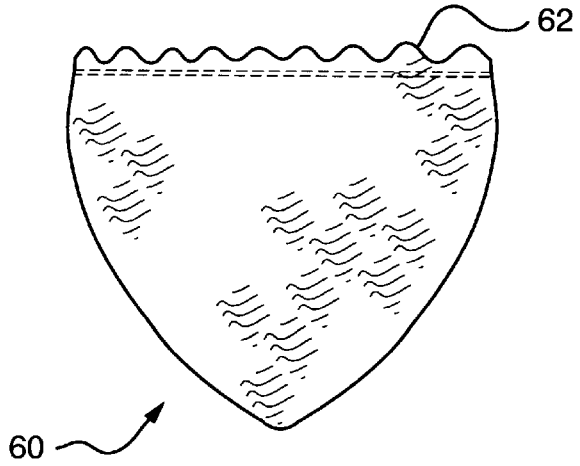
FIG. 7 is a side view of the flannel head cover of the cleaning kit of the present invention.

Referring now to FIGS. 3 and 6, the preferred cleaning apparatus 10 also includes an accessory holder 31. As shown in FIG. 6, the accessory holder 31 is made up of a shelf 34 and hook and loop strips 36 attached to the handle 30. The hook and loop strips 36 and the shelf 34 are preferably made of stainless steel and coated with plastic, and are removably connected to the handle 30. The hook and loop strips 36 are preferably used to secure bottles of cleaning chemicals by wrapping the hook and loop strips tightly around the bottle, and the bottle then rests on the shelf 34. However, the hook and loop strips 36 may also be adapted to hold other things, such as paper towels, a squeegee, or various other specialized cleaning accessories not included in the cleaning kit. In other embodiments of the accessory holder 31, however, the shelf 34 and hook and loop strips 36 are replaced by the clip 34 shown in FIG. 3, by a locking loop, a single strap, or other art recognized means of holding a desired cleaning accouterment.

As described above the cleaning apparatus 10 is indeed an all-purpose cleaning apparatus capable of cleaning a variety of surfaces. It is envisioned that the cleaning apparatus 10 will be sold in kit form, with the head 12, handle 30 and other accessories ready for assembly. In the preferred embodiment of the kit, a head cover 60 is also included to allow the cleaning apparatus 10 to be used as a dry mop, or as a tool for dusting and polishing wood. As shown in FIG. 8, the preferred head cover 60 is a soft, thick reversible flannel cover that fits over the cleaning tool, and is kept in place by an elastic 62, which firmly secures the head cover 60 about the head 12 of the cleaning apparatus 10. In this manner, the head cover 60 allows the apparatus 10 to be quickly converted from a wet cleaning tool to a dry cleaning tool.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A cleaning apparatus comprising:

head having a substantially triangular shape and opposed top and bottom surfaces, said head comprising:

a front portion having an interior and an exterior, wherein a plurality of substantially long hard bristles extend from said exterior of said front portion, and wherein a plurality of substantially short soft bristles extend from said interior of said front portion; and a rear portion comprising an absorbent material, said front and rear portions each being on one of the top and bottom surfaces.

2. The cleaning apparatus as claimed in claim 1, further comprising a handle attached to said rear portion of said head.

3. The cleaning apparatus as claimed in claim 2, wherein said handle is removably attached to said rear portion of said head.

4. The cleaning apparatus as claimed in claim 2, wherein said handle is pivotally attached to said rear portion of said head.

5. The cleaning apparatus as claimed in claim 2 wherein said handle is a telescoping handle.

6. The cleaning apparatus as claimed in claim 2, further comprising an accessory holder attached to said handle.

7. The cleaning apparatus as claimed in claim 6 wherein said accessory holder is dimensioned to secure a bottle to said handle.

8. The cleaning apparatus as claimed in claim 7 wherein said accessory holder comprises a shelf and at least two hook and loop strips attached to said handle.

9. The cleaning apparatus as claimed in claim 1 wherein said top surface is disposed in substantially parallel relation to said bottom surface.

10. The cleaning apparatus as claimed in claim 9 wherein said top surface is disposed a predetermined distance from said bottom surface such that said head has a substantially low profile.

11. The cleaning apparatus as claimed in claim 1 wherein said front portion of said head is substantially rounded.

12. The cleaning apparatus as claimed in claim 1 wherein said absorbent material is a sponge material.

13. A cleaning kit comprising:

a bead having a substantially triangular shape and opposed top and bottom surfaces, said head comprising:

a front portion having an interior and an exterior, wherein a plurality of substantially long bard bristles extend from said exterior of said front portion, and wherein a plurality of substantially short soft bristles extend from said interior of said front portion; and a rear portion comprising a sponge material said front and rear portions each being on one of the top and bottom surfaces; and a handle dimensioned for attachment to said head.

14. The cleaning kit as claimed in claim 13, further comprising a pivotal joint disposed upon said head and dimensioned to pivotally receive said handle.

15. The cleaning kit as claimed in claim 13 wherein said handle is a telescoping handle.

16. The cleaning kit as claimed in claim 13, further comprising an accessory holder attached to said handle.

17. The cleaning kit as claimed in claim 13, further comprising a dusting cover dimensioned for attachment to said head.

18. The cleaning kit as claimed in claim 17 wherein said dusting cover comprises an elastic portion for securing said dusting cover to said head.

19. The cleaning kit as claimed in claim 17 wherein said dusting cover is manufactured of a flannel material.

* * * * *